US008513869B2

(12) United States Patent
Noguchi et al.

(10) Patent No.: US 8,513,869 B2
(45) Date of Patent: Aug. 20, 2013

(54) IMAGE DISPLAY APPARATUS WITH RIB PATTERN

(75) Inventors: Atsushi Noguchi, Numazu (JP); Yoshitaka Ishioka, Koza-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 171 days.

(21) Appl. No.: 13/085,213

(22) Filed: Apr. 12, 2011

(65) Prior Publication Data

US 2011/0254433 A1 Oct. 20, 2011

(30) Foreign Application Priority Data

Apr. 14, 2010 (JP) ..... 2010-093162

(51) Int. Cl.
*H01J 17/49* (2012.01)

(52) U.S. Cl.
USPC ..... 313/495; 313/497

(58) Field of Classification Search
USPC ..... 313/495–497
See application file for complete search history.

(56) References Cited

U.S. PATENT DOCUMENTS

| | | | |
|---|---|---|---|
| 5,821,689 | A | 10/1998 | Andoh et al. |
| 6,384,527 | B1 | 5/2002 | Spindt et al. |
| 2006/0082283 | A1 | 4/2006 | Yotani et al. |
| 2009/0033203 | A1 | 2/2009 | Kojima et al. |
| 2009/0142703 | A1 | 6/2009 | Uchida et al. |

FOREIGN PATENT DOCUMENTS

| | | | |
|---|---|---|---|
| EP | 0631295 | A2 | 12/1994 |
| JP | 2-299136 | A | 12/1990 |
| JP | 2000-500613 | A | 1/2000 |
| JP | 2000-348651 | A | 12/2000 |
| JP | 2001-202909 | A | 7/2001 |

*Primary Examiner* — Anne Hines
(74) *Attorney, Agent, or Firm* — Canon USA Inc IP Division

(57) ABSTRACT

An image display apparatus includes first and second substrates, an electron emitting device, light emitting members, and a spacer located between the first and second substrates. Straight-line ribs higher than the light emitting members are formed on the second substrate with one of the lines of light emitting members interposed between each adjacent pair of ribs. The spacer extends in a second direction intersecting a first direction in which the ribs extend, and is located between the light emitting members adjacent to each other in the first direction. The ribs include first and second ribs, and each first rib includes a wide portion where it intersects the spacer, the wide portion having a large width in the second direction and being higher than parts of the second ribs intersecting the spacer, at least one of the second ribs being disposed between each adjacent pair of first ribs.

5 Claims, 5 Drawing Sheets

SECTION A-A'

SECTION B-B'

SECTION C-C'

SECTION A-A'

SECTION B-B'

SECTION C-C'

SECTION A-A'

SECTION B-B'

SECTION C-C'

IMAGE DISPLAY APPARATUS WITH RIB PATTERN

BACKGROUND OF THE INVENTION

1. Field of the Invention

The present invention relates to an image display apparatus including electron emitting devices, and a method for forming ribs on a substrate in an image display apparatus.

2. Description of the Related Art

An image display apparatus including electron emitting devices may include a rear plate and a faceplate. The electron emitting devices are formed on the rear plate. On the face plate, light emitting members are formed which emit light when irradiated with electrons emitted from the electron emitting devices. The electron emitting devices are operated in a thin hermetic container (a vacuum container) composed of the rear plate, the face plate, and other members. Hence, the hermetic container needs to have an atmospheric-pressure-resistant structure.

In manufacturing a large-area, thin image display apparatus, in light of weight and cost, spacers for providing resistance to atmospheric pressure are disposed as supports between a rear plate and a face plate.

Japanese Patent Application Laid-Open No. 02-299136 discusses an example employing such spacers. Also, in Japanese Patent Application Laid-Open No. 2000-348651, to prevent a phosphor surface (where light emitting members are provided) of a face plate from being damaged due to, e.g., misalignment or deformation of spacers, ribs are formed on the face plate, projecting from the phosphor surface. In this image display apparatus, the straight ribs of uniform width abut on the spacers. Those ribs prevent the spacers from directly abutting on the phosphor surface of the face plate. Thus, even if the spacers become misaligned or deformed to some degree, the electron emitting devices and the phosphor surface are not damaged, thereby facilitating the assembly of the image display apparatus.

Japanese Unexamined Patent Application Publication (Translation of PCT Application) No. 2000-500613 describes a structure in which a scattering shield (ribs) higher than light emitting members by about 20 to 200 μm is provided to reduce the number of backscattered electrons re-entering the light emitting members. Accordingly, ribs not only abut on the spacers that provide resistance to atmospheric pressure, but also function as a scattering shield for reducing the number of backscattered electrons re-entering the phosphors (light emitting members).

In a structure in which spacers abut on ribs formed on a face plate, if the ribs have a uniform height, the load imposed by the spacers can be distributed among all ribs. However, despite efforts to form ribs of desired height, the resultant ribs vary in height to some extent. Consequently, the spacers may abut on ribs of higher height only.

When such ribs of various heights abut on spacers in assembling an image display apparatus, a shear force may be applied to the ribs due to, e.g., misalignment or deformation of the spacers. In that case, the magnitude of the shear force applied also varies among the ribs according to the variations in the height of the ribs. When only a few ribs have higher height, a shear stress produced in those ribs being in abutment on the spacers is increased, which may cause failure of the ribs.

To ensure the strength of the ribs, the ribs may be increased in width. However, the width of the ribs can be increased only to a limited extent because of limitations on the available area where other members, such as light emitting members, are also disposed. If, to overcome these area limitations, ribs of narrower width are formed, rib failure may occur when the spacers abut on those narrow-width ribs.

SUMMARY OF THE INVENTION

According to the present invention, there is provided an image display apparatus capable of preventing the possibility of failure of ribs. There is also provided a method for easily forming ribs on a substrate (face plate) in an image display apparatus.

In an image display apparatus according to an exemplary embodiment of the present invention, parts of ribs that abut firmly on spacers have a large width to enhance the shear strength of the ribs. The enhanced shear strength reduces the possibility of rib failure occurring due to misalignment or deformation of the atmospheric-pressure-resistant spacers and due to variations in the rib height when the spacers abut on the ribs.

According to a rib formation method in accordance with the present invention, straight-line ribs of constant width and straight-line ribs including a wide portion higher and wider than the straight-line ribs are easily formed on a substrate.

According to an aspect of the present invention, an image display apparatus includes a first substrate and a second substrate facing each other and forming a hermetic container in which pressure is reduced, an electron emitting device disposed on an inner surface of the first substrate, a plurality of light emitting members arranged in a matrix of lines on an inner surface of the second substrate, and configured to emit light when irradiated with electrons emitted from the electron emitting device, and a spacer located between the first and second substrates and supporting the hermetic container from the inside, and a plurality of straight-line ribs higher than the light emitting members are formed on the second substrate with one of the lines of light emitting members interposed between each adjacent pair of ribs. The spacer extends in a second direction intersecting a first direction in which the ribs extend, and is located between the light emitting members adjacent to each other in the first direction. The ribs include two or more first ribs and one or more second ribs, and each first rib includes a wide portion in a part where the first rib intersects the spacer, the wide portion having a large width in the second direction and being higher than parts of the second ribs in which the second ribs intersect the spacer, at least one of the second ribs being disposed between each adjacent pair of first ribs.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Image display apparatuses according to exemplary embodiments of the present invention are suitably applicable to electron beam display apparatuses, such as cathode ray tubes (CRTs) and field emission displays (FEDs), and to plasma display apparatuses. In particular, FEDs, in which spacers define the clearance between a face plate and a rear plate which configure a vacuum container, are a suitable form to which the present invention is applicable.

Figure 1:
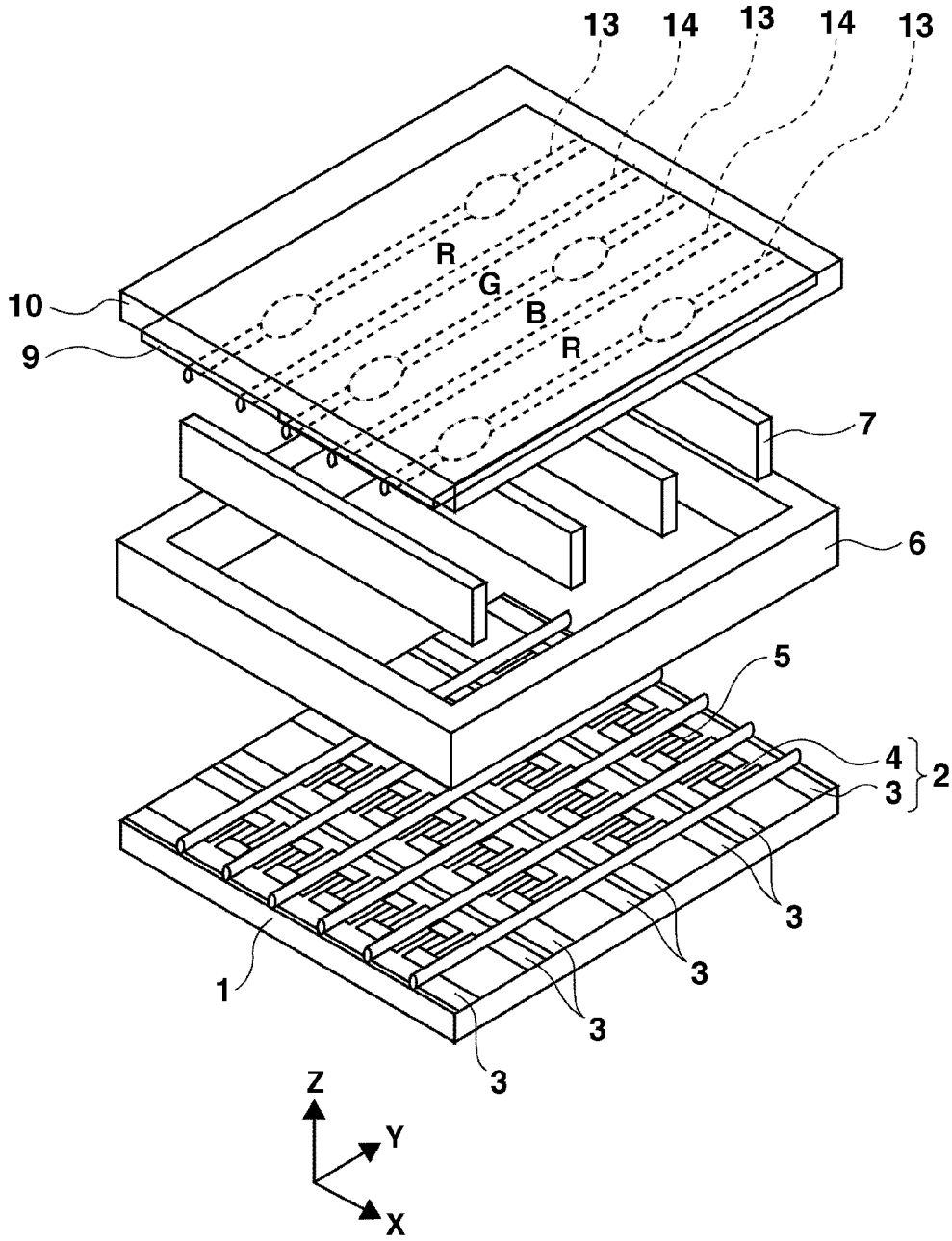
FIG. 1 is an exploded perspective view illustrating an image display apparatus according to a first exemplary embodiment of the present invention.

FIG. 1 is an exploded perspective view illustrating an image display apparatus according to a first exemplary embodiment of the present invention. The image display apparatus includes a rear plate (first substrate) 1, a face plate (second substrate) 10, and spacers 7 interposed between the rear plate 1 and the face plate 10. The rear plate 1 and the face plate 10, disposed to face each other, form a hermetic container in which the pressure is reduced.

Specifically, the hermetic container includes the rear plate 1, the faceplate 10, and a frame member 6. The frame member 6 may be an individual unit separate from the rear plate 1 and the face plate 10, or may be a portion integral with the rear plate 1 or the face plate 10.

Electron emitting devices 5 are provided on the inner surface (an inner surface of the hermetic container) of the rear plate 1. The electron emitting devices 5 may be cold-cathode electron emitting devices. On the rear plate 1, a matrix of wires 2, composed of X-direction wires 3 and Y-direction wires 4, is formed. The matrix of wires 2 is used to drive each electron emitting device 5 according to an image signal.

On the inner surface of the face plate 10, light emitting members (phosphor pixels) 9 are provided. The light emitting members 9 emit light when irradiated with electrons emitted from the electron emitting devices 5. The light emitting members 9 are provided in openings of a black matrix (not shown) formed on the face plate 10. The light emitting members 9 are colored with red (R), green (G), and blue (B) phosphors, for example.

The set of electron emitting devices 5 and the set of light emitting members 9 are each arranged in a matrix of lines. On the face plate 10, ribs 13 and 14 are formed in straight lines, with each line of light emitting members 9 interposed between adjacent ribs 13 and 14. These protruding ribs 13 and 14 are higher than the light emitting members 9, and project beyond the light emitting members 9 toward the rear plate 1. The ribs 13 and 14 extend in one direction (the Y direction in the figure).

The spacers 7 extend in a direction (the X direction in the figure) intersecting the ribs 13 and 14. The spacers 7 are disposed between the rear plate 1 and the face plate 10 to support the hermetic container from the inside and withstand atmospheric pressure applied to the hermetic container. Each spacer 7 is located between light emitting members 9 adjacent to each other in the Y direction.

Figure 2A:
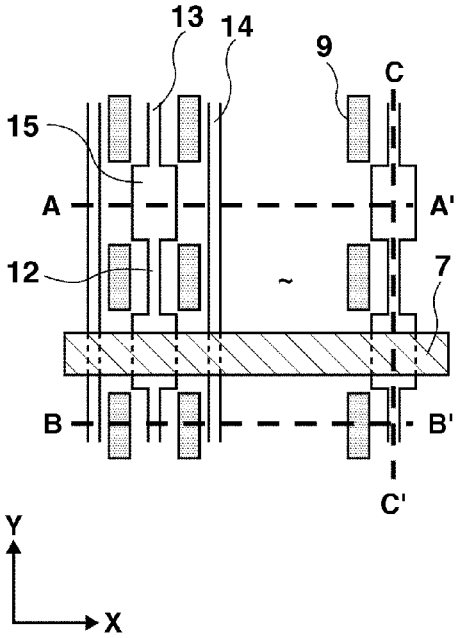
FIGS. 2A to 2D schematically illustrate the shapes of ribs formed on a face plate.
Figure 2B:
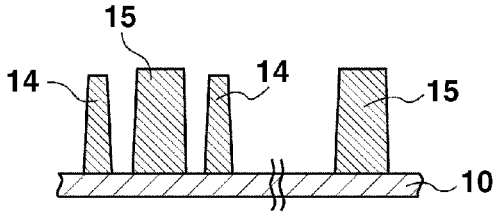
Figure 2C:
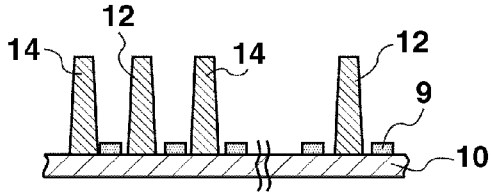
Figure 2D:
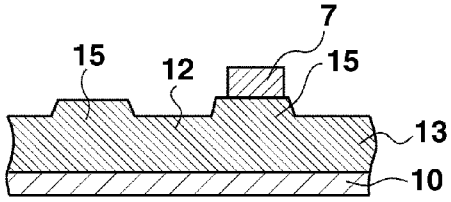

FIGS. 2A to 2D illustrate the shapes of the ribs 13 and 14 formed on the face plate 10. FIG. 2A is a schematic plan view illustrating the face plate 10 as viewed from above the surface thereof facing the rear plate 1. FIGS. 2B, 2C, and 2D are schematic cross sectional views taken along the lines A-A', B-B', and C-C', respectively, of FIG. 2A. FIGS. 2A to 2D illustrate the spacers 7, the ribs 13 and 14, and the phosphor pixels 9.

In the present exemplary embodiment, the ribs 13 and 14 extend in the Y direction, and are aligned in the X direction. The ribs 13 have wide portions 15 (hereinafter referred to as "first ribs"), and the ribs 14 have no wide portions 15 (hereinafter referred to as "second ribs"). These two types of ribs are provided.

In the present exemplary embodiment, the second ribs 14 of constant width each extend in a straight line. The first ribs 13 have general portions 12 and the wide portions 15. Each general portion 12 having substantially the same width as the second ribs 14 extends in a straight line. The wide portions 15 are formed to have a large width in the direction (the X direction) in which the spacers 7 extend. The wide portions 15 are formed in those parts of the first ribs 13 in which the first ribs 13 intersect the spacers 7. The wide portions 15 may be periodically formed in the direction (the Y direction) in which the first ribs 13 extend. The first and second ribs 13 and 14 function as a scattering shield for preventing or suppressing re-entry (halation) of backscattered electrons into the phosphor pixels 9.

The wide portions 15 of the first ribs 13 are higher than the second ribs 14, more particularly, higher than those parts of the second ribs 14 in which the second ribs 14 intersect the spacers 7. In the present exemplary embodiment, the wide portions 15 are higher than the general portions 12 (the portions other than the wide portions 15). For example, when the second ribs 14 have a height of 200 μm, the wide portions 15 may be higher than the second ribs 14 by about 2 to 10 μm.

The wide portions 15 of the first ribs 13 are to abut on the spacers 7. Thus, the spacers 7 abut on the wide portions 15 that are higher than the other rib portions 12 and the second ribs 14. On the other hand the second ribs 14, which are lower than the wide portions 15, do not abut on the spacers 7.

In the present exemplary embodiment, the wide portions 15 of the first ribs 13 have higher shear strength (strength against shear) than the general portions 12 and the second ribs 14. Thus, the wide portions 15 have sufficiently high strength against the shear produced when the wide portions 15 abut on the spacers 7. Even if the ribs 13 and 14 vary in height to some extent, the second ribs 14 having low shear strength do not abut on the spacers 7 or abut on the spacers 7 with a slight force applied thereto because the wide portions 15 support the spacers 7. Accordingly, even if misalignment or deformation, e.g., of the spacers 7 applies a shear force to the ribs 13 and 14, the possibility of failure of the ribs 13 and 14 is reduced.

Generally, to enhance the shear strength of the ribs 13 and 14, the ribs 13 and 14 need to be increased in width or reduced in height. However, if all of the ribs 13 and 14 have a large width, the spacing between adjacent ribs 13 and 14 is narrowed. Such narrowed spacing requires the light emitting members 9 between the ribs 13 and 14 to be reduced in size, resulting in lower-intensity light emitted from the light emitting members 9. If the ribs 13 and 14 are reduced in height, their function as a shield against electron scattering decreases, allowing halation to easily occur and possibly leading to degradation in the performance of the image display apparatus.

In the present exemplary embodiment, two or more first ribs 13 are provided with at least one second rib 14 disposed between adjacent first ribs 13. Hence, the ribs 13 having the wide portions 15 are not located adjacent to each other. This ensures the area where the light emitting members 9 are disposed, while increasing the strength of the wide portions 15 that abut on the spacers 7.

To increase shear strength, all of the ribs 13 and 14 may be formed with the wide portions 15 having the largest possible width. However, when the spacing between adjacent ribs is uniform, such uniform spacing imposes limitations on the formation of the wide portions 15 in all of the ribs 13 and 14. This is because the width of the wide portions 15 must be set smaller than the spacing between adjacent ribs.

Nevertheless, the width of the wide portions 15 can be increased by placing one or two second ribs 14 between adjacent first ribs 13 having the wide portions 15. This allows shear strength to be maximized even if the spacing between adjacent ribs is uniform. In particular, the width of the wide portions 15 in the direction in which the spacers 7 extend can be set greater than the spacing between light emitting members 9 in that direction.

As set forth above, the wide portions 15 are formed higher than the second ribs 14 so as to prevent the spacers 7 from abutting on the second ribs 14, so that the wide portions 15 having high shear strength share a function of holding the spacers 7. However, the ribs 13 and 14 may vary in height to some degree. Thus, in the present invention, although the first ribs 13 have the wide portions 15 formed to abut on the spacers 7, all of the wide portions 15 need not abut on the spacers 7 in the resultant apparatus. Likewise, the second ribs 14, formed so as not to abut on the spacers 7, may abut on the spacers 7 in the resultant apparatus. Even in those cases, the possibility of failure of the second ribs 14 is reduced because the wide portions 15 higher than the second ribs 14 reduce the force (shear force) applied from the spacers 7 to the second ribs 14.

The width of the wide portions 15 of the first ribs 13 may be determined depending on the number, shear strength, and compressive strength of the first ribs 13. The shear strength (bending strength) of ribs is inversely proportional to stress applied to the bottoms of the ribs. Hence, the shear strength (bending strength) of ribs is proportional to the square of the width of the ribs, and inversely proportional to the magnitude of shear load applied to each rib and the height of the ribs.

The shear load applied to each first rib 13 is a reciprocal of the ratio of the number of first ribs 13 to the total number of first and second ribs 13 and 14. For example, suppose that half of all ribs 13 and 14 are the first ribs 13. In that case, the shear load per rib doubles as compared to when all of the ribs 13 and 14 abut on the spacers 7. When one third of all ribs 13 and 14 are the first ribs 13, the shear load per rib triples.

Hence, to increase the ribs' shear strength as compared to a case where none of the ribs 13 and 14 have the wide portions 15, and thus all of the ribs 13 and 14 abut on the spacers 7, the width of the wide portions 15 may be set as follows. The width of the wide portions 15 of the first ribs 13 may be set equal to or greater than $(1/R)^{1/2}$ times the width, in the X direction, of the parts of the second ribs 14 in which the second ribs 14 intersect the spacers 7, where R is the ratio of the number of first ribs 13 to the total number of ribs 13 and 14.

For example, when half of the total number of ribs 13 and 14 are the first ribs 13, the width of the wide portions 15 may be set equal to or greater than $2^{1/2}$ times that of the second ribs 14. When one third of all ribs 13 and 14 are the first ribs 13, the width of the wide portions 15 may be set equal to or greater than $3^{1/2}$ times that of the second ribs 14. The wide portions 15 of such width enhance the strength against shear force applied to each rib (wide portion 15) as compared to when all ribs 13 and 14, each having no wide portions, are in abutment on the spacers 7.

The compressive strength of ribs is proportional to the abut area in which the ribs abut on the spacers 7. This abutting area is proportional to the product of the width of the wide portions 15 of the first ribs 13, the width of the spacers 7, and the number of first ribs 13. Providing one first rib 13 for each one or two second ribs 14 ensures such width of the wide portions 15 as increasing the shear strength as compared to the conventional example, while allowing the compressive strength to be maintained at a sufficiently high level.

A method for forming ribs on a substrate will be described with reference to FIGS. 3A to 3F. FIGS. 3A to 3F illustrate a method for forming ribs on a substrate (face plate) in an image display device.

First, a glass substrate 10 with a black matrix 16 formed thereon is prepared. The black matrix 16 has a predetermined pattern in which openings are formed in portions where phosphor pixels 9 are to be provided (see FIG. 3A). As the glass substrate 10, a soda lime glass, for example, (e.g., a glass substrate PD 200 for PDP manufactured by ASAHI GLASS CO., LTD) may be used.

Figure 3A:
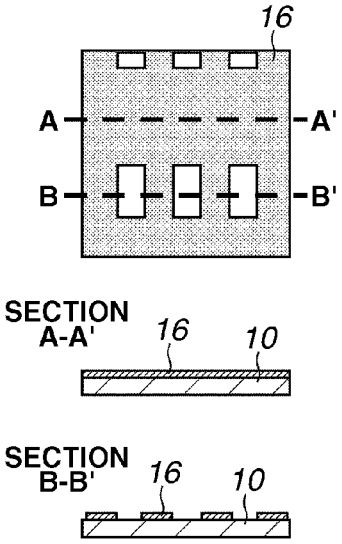
FIGS. 3A to 3F schematically illustrate a method for forming the face plate.
Figure 3B:
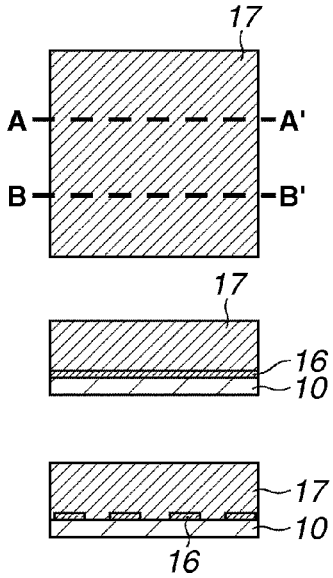

Next, a paste 17 for ribs is applied in a uniform thickness to the entire surface of the glass substrate 10 (see FIG. 3B). As the paste 17 for ribs, a photo paste containing at least a glass component and a photo-curing resin may be used. The paste 17 may contain a solvent and/or an initiator, for example. The paste for ribs 17 may be applied by screen printing, slit coating, or other method. However, considering the rib height (about 20 to 200 μm) required to suppress halation, slit coating is suitable.

Subsequently, in an exposure step, exposure patterns 14 and 15 of straight lines are formed in the photo paste 17. The lines of the exposure patterns 14 and 15 correspond to the parts to be left as ribs in a later step, and thus are given the same reference numerals as those corresponding rib portions and ribs described above.

Figure 3C:
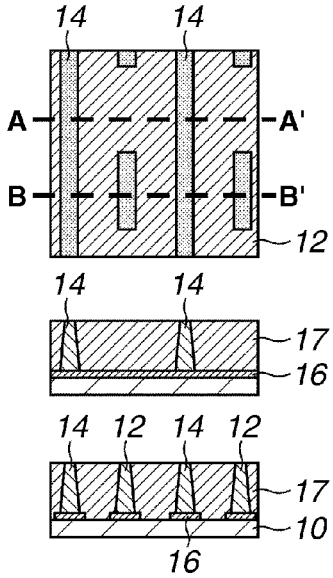
Figure 3D:
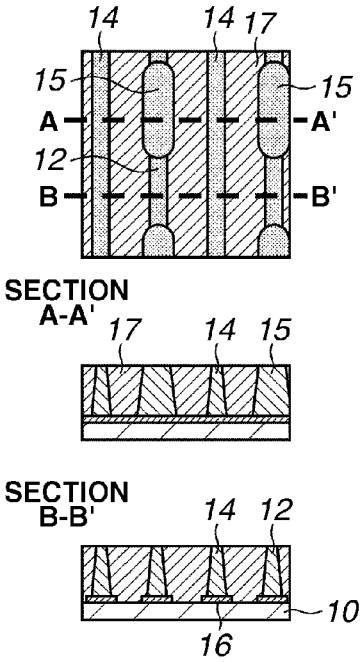
Figure 3E:
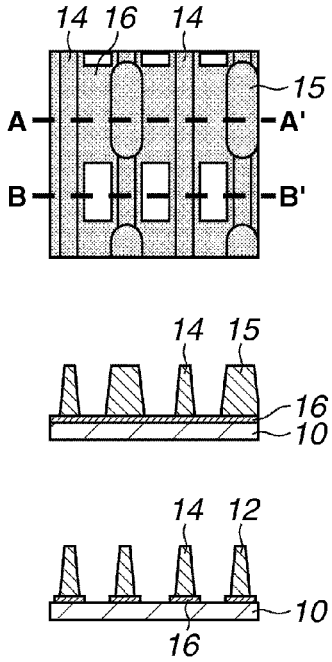
Figure 3F:
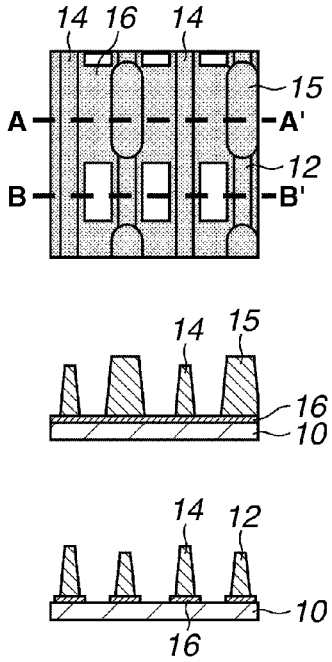

Specifically, the lines of the patterns 14 and 12 corresponding only to the second ribs 14 and the general portions 12 of the first ribs 13 are exposed to light (see FIG. 3C). Then, the wide exposure portions 15 corresponding only to the wide portions 15 of the first ribs 13 are exposed to light (see FIG. 3D). More specifically, of the lines of the exposure patterns, at least one line of a first exposure pattern 13 has the wide exposure portions 15 having a large width in a second direction intersecting a first direction in which the lines of the exposure patterns extend. The lines of the second exposure pattern 14 have a constant width in the second direction. Either the exposure of the patterns 14 and 12 corresponding to the second ribs 14 and the general portions 12 of the first ribs 13 or the exposure of the wide exposure portions 15 corresponding to the wide portions 15 may be performed first.

Then, all of the exposure patterns are developed and baked together. Specifically, unnecessary parts of the paste for ribs 17 are removed by development (see FIG. 3E). After development, the ribs 13 and 14 are formed on the substrate 10 by baking (see FIG. 3F).

Differences in rib height occur during baking. Such differences in height are achieved by utilizing differences in shrinkage between the wide portions (the wide exposure portions) 15 of the first ribs 13 and the general portions (the parts of the first exposure portions other than the wide exposure portions) 12 of the first ribs 13 and between the wide portions (the wide exposure portions) 15 and the second ribs (the second exposure portions) 14.

The wide portions 15, which are large in volume, shrink considerably, while the general portions 12 other than the wide portions 15, and the second ribs 14 shrink slightly. Accordingly, when the wide portions 15 and the general portions 12 connected together shrink at the same time, the paste 17 moves to the wide portions 15 that shrink more. This results in deformation of the paste 17, producing height differences between the ribs 13 and 14. Specifically, by utilizing differences in shrinkage between the ribs 13 and 14, the wide portions 15 of the first ribs 13 can be formed higher than the general portions 12 and the second ribs 14.

Presumably, the ribs 13 and 14 shrink because the resin in the paste 17 is decomposed during baking to create voids, and those voids are filled with the glass component heated to a temperature equal to or higher than a glass-transition temperature.

Therefore, to adjust the amount of shrinkage, the amount of resin in the paste 17 may be increased, and a glass component whose glass-transition temperature is sufficiently lower than the baking temperature may be used. Then, the shrinkage of the wide portions 15 increases, enabling differences in rib height to be produced.

For example, the solid content in the paste 17 may contain 30 to 70 wt % of resin, more preferably 40 to 60 wt % of resin. The glass component may contain a high percentage of borosilicate glass as a low softening point substance. Desired differences in the height of the ribs 13 and 14 can be easily produced by developing and baking all of the exposure patterns together as set forth above.

In the exposure step, the wide exposure portions 15, and the exposure portions other than the wide exposure portions 15 may be exposed separately, and a dose of exposure for the wide exposure portions 15 may be greater than that for the other exposure portions. Then, the degree of resin cross-linking and the amount of resin to be cured can be changed to produce differences in the amount of resin decomposed during baking and thereby adjust the height of the ribs.

Specifically, a higher degree of cross-linking in the wide portions 15 results in a smaller amount of resin elution during development, thus allowing a larger amount of resin to remain in the wide portions 15. Contrary to this, in the general portions 12 and the second ribs 14 having a lower degree of cross-linking than the wide portions 15, the amount of resin eluted during development is large, resulting in a small amount of resin remaining therein. Consequently, during baking, the wide portions 15 in which a large amount of resin remains shrink considerably, while the general portions 12 and the second ribs 14 in which a small amount of resin is left shrink slightly. This method can produce further differences in rib height.

A method for fabricating an image display apparatus using a face plate 10 with ribs 13 and 14 formed thereon will be described. First, light emitting members 9 are formed in openings in a black matrix 16 on the face plate 10. A metal back (not shown) is then formed on the light emitting members 9. A rear plate 1 having electron emitting devices 5 thereon is prepared. The rear plate 1 and the face plate 10 are placed to face each other with spacers 7 interposed therebetween, forming a hermetic container in which airtightness is maintained.

Figure 4A:
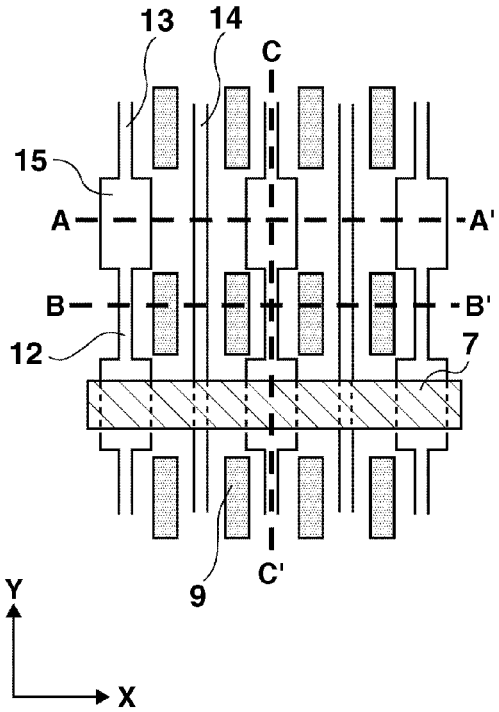
FIGS. 4A to 4D schematically illustrate the shapes of ribs formed on a face plate according to the first exemplary embodiment.
Figure 4B:
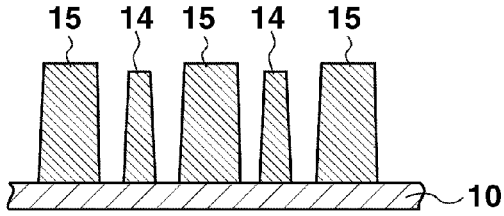
Figure 4C:
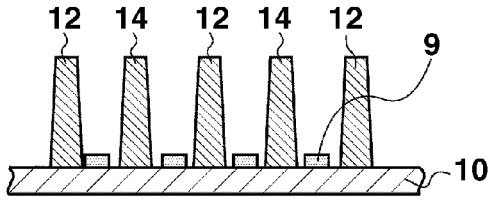
Figure 4D:
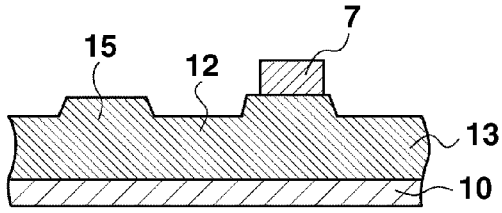

FIGS. 4A to 4D illustrate the structure of the face plate 10 in the first exemplary embodiment. FIG. 4A is a plan view illustrating the face plate 10. FIGS. 4B, 4C, and 4D are cross sectional views taken along the lines A-A', B-B', and C-C', respectively, of FIG. 4A.

In FIGS. 4A to 4D, the first ribs 13 having the wide portions 15 and the second ribs 14 having no wide portions 15 are provided alternately. These ribs 13 and 14 are formed on both sides of lines of phosphor pixels 9 so that each line of phosphor pixels 9 is located between adjacent ribs 13 and 14. The number of ribs 13 and 14 formed corresponds to the number of lines of phosphor pixels 9.

FIGS. 4A to 4D illustrate the spacers 7, the first ribs 13, the second ribs 14, and the phosphor pixels 9. The wide portions 15 of the first ribs 13 are located between adjacent phosphor pixels 9 arranged in a line, and fifteen wide portions 15 are periodically provided. The width of the wide portions 15 is increased in the direction (X direction) perpendicular to the direction in which the ribs 13 and 14 extend. In the first exemplary embodiment, the image display apparatus includes 25 spacers 7.

The dimensions of the members in the present exemplary embodiment are as follows. In the first ribs 13, the top of each wide portion 15 has a width of 125 μm, and the top of each general portion 12 has a width of 55 μm. The width of the top of each second rib 14 is 55 μm. In the first ribs 13, the bottom of each wide portion 15 has a width of 170 μm, and the bottom of each general portion 12 has a width of 78 μm. The width of the bottom of each second rib 14 is 78 μm. In the first ribs 13, each wide portion 15 has a height of 205 μm, and each general portion 12 has a height of 196 μm. The height of each second rib 14 is 200 μm. The spacings between the tops of adjacent first and second ribs 13 and 14 are as follows: the spacing between adjacent wide and general portions 15 and 12 is 120 μm, while the spacing between adjacent general portions 12 is 155 μm. The dimensions of each phosphor pixel 9 are 106 μm in the X direction by 250 μm in the Y direction.

The respective widths of the top and bottom of each wide portion 15 of the first ribs 13 are both greater than twice the respective widths of the top and bottom of each second rib 14 (the top: 2.27 times, the bottom: 2.18 times). In this way, the dimensions of these members are such that compressive strength and shear strength are both enhanced as compared to the conventional rib structure. Actual measured values of compressive strength and shear strength will be provided later.

The wide portions 15 of the first ribs 13 are higher than the general portions 12 of the first ribs 13, and higher than the second ribs 14 that are adjacent to the wide portions 15 in the X direction. The first ribs 13 are to abut on the spacers 7. Thus, the spacers 7 abut on some or all of the wide portions 15 that are higher than the other rib portions 12 and the second ribs 14. The first ribs 13 also prevent backscattered electrons from re-entering the phosphors, to thereby reduce halation. The second ribs 14, which do not abut on the spacers 7, prevent backscattered electrons from re-entering the phosphors, to thereby reduce halation.

A method for forming the ribs according to the present exemplary embodiment will be described. The rib formation method is the same as the method set forth above. Hence, in the following, conditions in each process step will be described.

A paste (photosensitive paste TPR-8100 manufactured by Toray Industries Inc.) containing borosilicate glass powder is applied, using a slit coater, to the entire surface of the glass substrate 10 in a thickness of 476 μm. The coated glass substrate 10 is dried at 95° C. for 60 minutes, and then subjected to proximity exposure processes.

In the first exposure process, only the exposure portions (the portions other than the wide exposure portions 15) having a constant width and extending in straight lines are exposed to light with a gap of 450 μm and an exposure dose of 290 mJ/cm$^2$. In the second exposure process, only the wide exposure portions 15 are exposed to light with a gap of 450 μm and an exposure dose of 350 mJ/cm$^2$.

After the completion of the two exposure processes, the glass substrate 10 is baked at 110° C. for 7 minutes. Then, the glass substrate 10 is subjected, for 390 seconds, to a development process using a liquid developer containing 0.5 wt % of sodium carbonate. The glass substrate 10 is then rinsed with water for 180 seconds to remove unnecessary paste. After the development process, the glass substrate 10 is baked at 580° C. for 28 minutes. After the baking process, the ribs of the above-described dimensions are obtained.

The shear strength of the ribs formed in the present exemplary embodiment was measured in the following manner. The substrate 10 was placed so that the X direction thereof was perpendicular to the ground with the side faces of the ribs 14 and 15 facing upwardly. An indenter having a pointed tip, such as a needle or a blade, was pressed to the top of the rib. The indenter was then vertically lowered to place a load on the top of the rib. The value of the load at the time when the failure of the rib occurred was measured as the shear strength.

When measured in this way, the shear strength of the ribs having the wide portions 15 according to the present exemplary embodiment was 0.85 N, while the shear strength of conventional structure ribs of constant width was 0.25 N. Hence, the ribs according to the present exemplary embodiment have the enhanced shear strength as compared to the conventional example. The result of measurement of the shear strength of the conventional rib structure will be provided later (Comparative Example 1).

The compressive strength of the ribs formed according to the present exemplary embodiment was measured in the following manner. The compressive strength was measured by performing a compressive crush test using a microcompression tester (MCT-W500 manufactured by Shimadzu Corporation). A flat indenter 50 μm in diameter was lowered from its position directly above the rib to apply a compressive load on the rib until the failure of the rib occurred. The value of the load at the time of the occurrence of the rib failure was measured as the compressive strength.

When measured in this way, the compressive strength of the wide portions 15 according to the present exemplary embodiment was equal to or higher than 1500 MPa (equal to or higher than the upper limit of the measuring range of the tester), while the compressive strength of the conventional structure ribs of constant width was 1500 MPa. Thus, the wide portions 15 according to the present exemplary embodiment have the enhanced compressive strength as compared to the conventional example. The result of measurement of the compressive strength of the conventional rib structure will be provided later (Comparative Example 1).

An image display apparatus was assembled using a face plate 10 having thereon ribs 13 and 14 according to the first exemplary embodiment, a rear plate 1 having thereon electron emitting devices 5, and spacers 7. Then the ribs 13 and 14 were checked whether there were failures.

The image display apparatus was assembled in the following manner. The spacers 7 and a frame member 6 were fixed on the rear plate 1 by jointing material. The rear plate 1 with the spacers 7 fixed thereon and the face plate 10 were aligned so that the electron emitting devices 5 and light emitting members 9 faced each other. In this alignment, the rear plate 1 and the face plate 10 were placed so that the spacers 7 and the wide portions 15 of the first ribs 13 on the face plate 10 abutted on each other. A sealing material was applied to the frame member 6 and then heated until melted, to thereby bond the peripheral portion of the face plate 10 and the rear plate 1. Then, the air was exhausted from the bonded structure through an exhaust pipe (not shown) provided in the rear plate 1, thereby forming an evacuated hermetic container.

Thereafter, a heating process was again performed to melt the sealing material. Then, the hermetic container was disassembled to check for failure of the ribs 13 and 14. As a result, it was confirmed that the rib structure formed according to the first exemplary embodiment produced a further increase in the shear strength of the ribs 13 and 14 to thereby prevent failure of the ribs 13 and 14 when the spacers 7 abutted on the ribs 13 and 14. This also provides design freedom in high definition displays.

In the conventional rib structure of Comparative Example 1, straight-line ribs of constant width are arranged at equal spaces. The width of the top of each rib is 55 μm. The rib-to-rib spacing between the tops of adjacent ribs is 155 μm. The shear strength of those ribs measured in the manner described above was 0.25 N. The compressive strength of those ribs measured in the manner described above was 1500 MPa.

In the example described in the first exemplary embodiment, the phosphor pixels 9 and the pixels are both spaced uniformly. However, the pitch distance between adjacent pixels may be nonuniform. A second exemplary embodiment employing a nonuniform pitch will be described below.

Figure 5A:
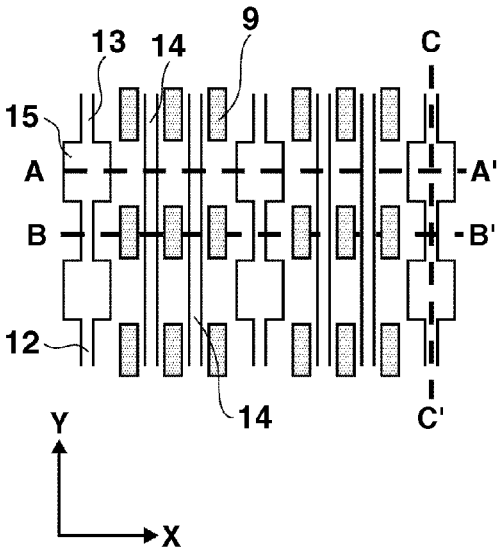
FIGS. 5A to 5D schematically illustrate the shapes of ribs formed on a face plate according to a second exemplary embodiment.
Figure 5B:
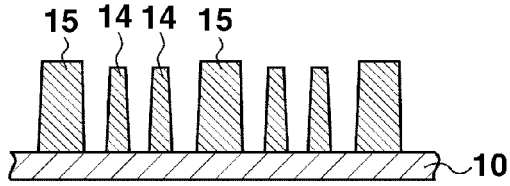
Figure 5C:
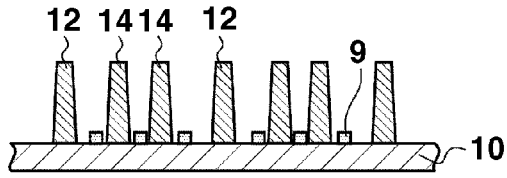
Figure 5D:
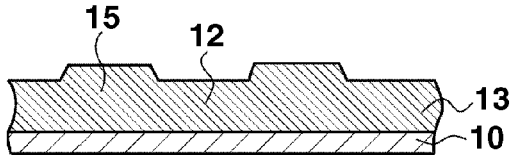

FIGS. 5A to 5D illustrate the shapes of ribs according to the second exemplary embodiment of the present invention. FIGS. 5A to 5D illustrate a structure in which two second ribs 14 having no wide portions 15 are present between two first ribs 13 having wide portions 15. FIG. 5A is a plan view illustrating a face plate 10. FIGS. 5B, 5C, and 5D are cross sectional views taken along the lines A-A', B-B', and C-C', respectively, of FIG. 5A.

The first and second ribs 13 and 14 according to the present exemplary embodiment have approximately the same dimensions as those in the first exemplary embodiment. Thus, only differences will be described below.

The top and bottom of each wide portion 15 of the first ribs 13 have a width of 160 μm and 225 μm, respectively. The spacing between the tops of adjacent first and second ribs 13 and 14 is 120 μm both when the wide-portion-to-general-portion distance is measured and when the general-portion-to-general-portion distance is measured.

In the present exemplary embodiment, the pixel pitch in the X direction is not uniform. The respective widths of the top and bottom of each wide portion 15 of the first ribs 13 are both about three times greater than the respective widths of the top and bottom of each second rib 14 (the top: 2.91 times, the bottom: 2.88 times). The compressive strength is equal to that of the conventional rib structure (Comparative Example 1), while the ribs are formed to have enhanced shear strength as compared to the conventional rib structure. Actual measured values of the compressive strength and shear strength will be provided later.

The wide portions 15 of the first ribs 13 are higher than the general portions 12 of the first ribs 13, and higher than the second ribs 14 adjacent to the wide portions 15 in the X direction. The first ribs 13 are to abut on the spacers 7. Thus, the spacers 7 abut on some or all of the wide portions 15 that are higher than the other rib portions 12 and the second ribs 14. The first ribs 13 also prevent backscattered electrons from re-entering the phosphor pixels 9, to thereby reduce halation. The second ribs 14, which do not abut on the spacers 7, prevent backscattered electrons from re-entering the phosphor pixels 9, to thereby reduce halation.

A method for forming the ribs according to the second exemplary embodiment is the same as that in the first exemplary embodiment. The shear strength of the ribs formed in the second exemplary embodiment is 0.85 N, which is enhanced as compared to the conventional rib structure. The shear strength was measured in the same manner as in the first exemplary embodiment. The compressive strength is 1500 MPa, which is equal to that of the conventional rib structure.

The image display apparatus according to the second exemplary embodiment was assembled and disassembled in the same ways as in the first exemplary embodiment. It was confirmed that the ribs formed according to the second exemplary embodiment achieved enhancing of shear strength to thereby prevent rib failure when the spacers 7 abutted on the ribs. This also provides design freedom in high definition displays.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-093162 filed Apr. 14, 2010, which is hereby incorporated by reference herein in its entirety.

What is claimed is:

1. An image display apparatus comprising:

a first substrate and a second substrate facing each other and forming a hermetic container in which pressure is reduced;

an electron emitting device disposed on an inner surface of the first substrate;

a plurality of light emitting members arranged in a matrix arrangement comprised of a plurality of rows and a plurality of columns on an inner surface of the second substrate, and configured to emit light when irradiated with electrons emitted from the electron emitting device;

a spacer located between the first and second substrates and supporting the hermetic container from the inside; and a plurality of straight-line ribs higher than the light emitting members are formed on the second substrate each of which is located along a column direction of the matrix arrangement, wherein the spacer extends in a row direction intersecting the column direction, and is located between adjacent two of the light emitting members in the column direction, and wherein the ribs include two or more first ribs and one or more second ribs, and each first rib includes a wide portion in a part where the first rib intersects the spacer, the wide portion having a large width in the row direction and being higher than parts of the second ribs in which the second ribs intersect the spacer, at least one of the second ribs being disposed between each adjacent pair of first ribs.

2. The image display apparatus according to claim 1, wherein one or two of the second ribs are disposed between each adjacent pair of first ribs.

3. The image display apparatus according to claim 1, wherein the width of the wide portion in the row direction is equal to or greater than spacing between the light emitting members adjacent to each other in the row direction.

4. The image display apparatus according to claim 1, wherein the width of the wide portion in the row direction is equal to or greater than $(1/R)^{1/2}$ times the width, in the row direction, of the parts of the second ribs in which the second ribs intersect the spacer, where R is a ratio of the number of first ribs to the total number of ribs.

5. The image display apparatus according to claim 1, wherein the electron emitting device is a cold-cathode electron emitting device.

* * * * *